US007445748B2

(12) United States Patent
Hauser

(10) Patent No.: US 7,445,748 B2
(45) Date of Patent: Nov. 4, 2008

(54) HOLDING FURNACE AND METERING DEVICE FOR METAL BATHS

(75) Inventor: Daniel Hauser, St. Gallen (CH)

(73) Assignee: Buhler Druckguss AG, Uzwil (CH)

( * ) Notice: Subject to any disclaimer, the term of this patent is extended or adjusted under 35 U.S.C. 154(b) by 392 days.

(21) Appl. No.: 10/553,023

(22) PCT Filed: Mar. 15, 2004

(86) PCT No.: PCT/CH2004/000148

§ 371 (c)(1),
(2), (4) Date: Oct. 11, 2005

(87) PCT Pub. No.: WO2004/089562

PCT Pub. Date: Oct. 21, 2004

(65) Prior Publication Data

US 2006/0214338 A1 Sep. 28, 2006

(30) Foreign Application Priority Data

Apr. 10, 2003 (DE) ..... 103 16 758

(51) Int. Cl.
*C21C 5/42* (2006.01)
*B67D 1/04* (2006.01)
*B67D 5/54* (2006.01)

(52) U.S. Cl. ..... 266/239; 266/236; 222/595

(58) Field of Classification Search ..... 266/200, 266/240, 242, 236, 239; 222/590, 591, 595; 164/119, 133–136, 306, 335–337
See application file for complete search history.

(56) References Cited

U.S. PATENT DOCUMENTS

| | | | | |
|---|---|---|---|---|
| 3,650,782 | A * | 3/1972 | Baum | 501/66 |
| 3,702,066 | A * | 11/1972 | Beatenbough et al. | 62/222 |
| 3,708,088 | A * | 1/1973 | Lesher | 222/595 |
| 3,708,599 | A * | 1/1973 | Krause | 373/60 |
| 4,189,697 | A * | 2/1980 | Hara | 337/407 |
| 4,793,596 | A | 12/1988 | Kubota et al. | |
| 6,073,596 | A * | 6/2000 | Kemper | 123/90.11 |
| 6,103,182 | A | 8/2000 | Campbell | |
| 6,426,037 | B1 * | 7/2002 | Fieber | 266/239 |
| 2004/0139965 | A1 * | 7/2004 | Greenleaf et al. | 128/200.23 |

FOREIGN PATENT DOCUMENTS

| | | | |
|---|---|---|---|
| DE | 198 21 650 | A1 | 11/1999 |
| DE | 100 34 946 | A1 | 3/2001 |
| EP | 0 967 034 | | 12/1999 |
| EP | 1 407 843 | A1 | 3/2002 |
| JP | 10-225758 | A | 11/1998 |
| JP | 2001-239357 | A | 7/2002 |
| JP | 2003-117649 | | 4/2003 |
| SU | 1435394 | | 4/1987 |
| WO | WO 99/15833 | | 4/1999 |
| WO | WO 02/100574 | A1 | 12/2002 |

* cited by examiner

*Primary Examiner*—Roy King
*Assistant Examiner*—Christine Chen
(74) *Attorney, Agent, or Firm*—Merchant & Gould P.C.

(57) ABSTRACT

The invention relates to a holding furnace comprising a metering device for molten metal, especially for precisely metering molten light metal during die casting, wherefore the holding furnace is provided with a dosing chamber encompassing a controlled discharge valve.

12 Claims, 5 Drawing Sheets

HOLDING FURNACE AND METERING DEVICE FOR METAL BATHS

BACKGROUND OF THE INVENTION

The invention relates to a holding furnace with a metering device for molten baths, in particular for metering light molten bath during diecasting.

DE-OS 2022989 describes an automated metering system for molten metal intended to precisely meter molten baths. The automated metering system is part of a holding furnace, which is charged with a molten bath by way of a loading flap. The melt to be metered is discharged through a discharge tube, which is provided with two measuring electrodes. If the melt is to be metered, the furnace is pressurized with compressed air, and the melt rises in the discharge tube until it reaches the measuring electrodes, so that a pulse is emitted to a controller. The set quantity of molten bath flows out of the discharge tube. The furnace is then ventilated via a timer, and the outflow of molten bath is abruptly terminated. However, the accuracy required for present-day conditions is inadequate, and the formation of slag is disadvantageous.

Also known is another device for casting molten metal according to DE-A-19821650, which has a metering container connected in terms of flow with the hearth of a holding furnace by means of a sealable opening. The metering container can be evacuated by exposure to compressed gas via a riser, wherein the opening is located in the bottom of the metering container, and can be sealed from inside by means of a valve gate on a valve rod. The opening is semicircular or conical. The valve rod and valve gate are arranged inside the metering container. The fill level in the metering container is determined by means of a fill level sensor in the metering container.

At the beginning of a metering process, melt flows of its own accord into the metering container via the open floor valve up to a predetermined working fill level. After reaching the desired level, the opening of the floor valve is closed by lowering and turning the valve gate. Backflow in the riser is possible during renewed filling of the metering container. Undesired oxides may deposit in the riser as a result.

DK 199800409 shows a similar solution, wherein the holding furnace is height-adjustable. The height is adjusted by means of a scissor-type jack.

DE-A-10034946 discloses a reciprocating pump, whose valve unit is comprised of an inlet and outlet valve combination. Such a valve is geometrically captive, and hence cannot be disassembled without a complicated process for cleaning the reciprocating pump.

SUMMARY OF THE INVENTION

The object of the invention is now to provide a holding furnace with a metering device for molten baths that enables a precise metering of molten baths, particular molten aluminum, without the disadvantages of prior art.

In one characteristic feature, a controlled outlet valve of a pneumatically operated metering chamber is connected with contact electrodes or alternative level sensors for molten baths. This outlet valve not only prevents the backflow of melt from the riser, but also increases metering accuracy, since no inconstant flow obstacles disrupt pneumatic metering. The melt level in the riser can be kept far to the top, near to the outlet. Oxides can only contaminate the riser and outlet valve to a slight extent.

A rotatable and tiltable metering chamber mount enables a far better adjustment of the conveying tube rigidly fixed with the metering chamber to the geometric conditions of the casting chamber to be filled, e.g., a diecasting machine. In addition, a small tilting motion makes it possible to decouple the metering unit from the casting chamber, which is exposed to strong vibrations.

A positioning aid has a docking unit in the form of a ceramic bushing, in particular made of a fiber-reinforced ceramic material. This ceramic bushing fits into an opening in the casing chamber, thereby enabling precise metering from below. To this end, the docking is further mounted in a spherical cap of the conveying tube, which additionally contains a sealing element. This arrangement makes it possible to adjust the angles, and also to balance out an axial displacement of up to ±2 mm. The opening is designed as a bushing, which is incorporated in a gray cast iron bushing.

The conveying tube is provided with a heater and foamed insulation.

To ensure a tight transition to the holding furnace, a ceramic sealing ring is arranged between the conveying tube and holding furnace, and additionally enveloped by a steel ring, which ensures an uninterrupted dissipation of thermal energy at the transition. Service life is increased, and handling is simplified.

BRIEF DESCRIPTION OF THE DRAWINGS

The invention will be explained in greater detail below in an exemplary embodiment based on a drawing. The drawing shows FIG. 1 a holding furnace, sectional view.

DETAILED DESCRIPTION OF THE PREFERRED EMBODIMENT

Figure 1:
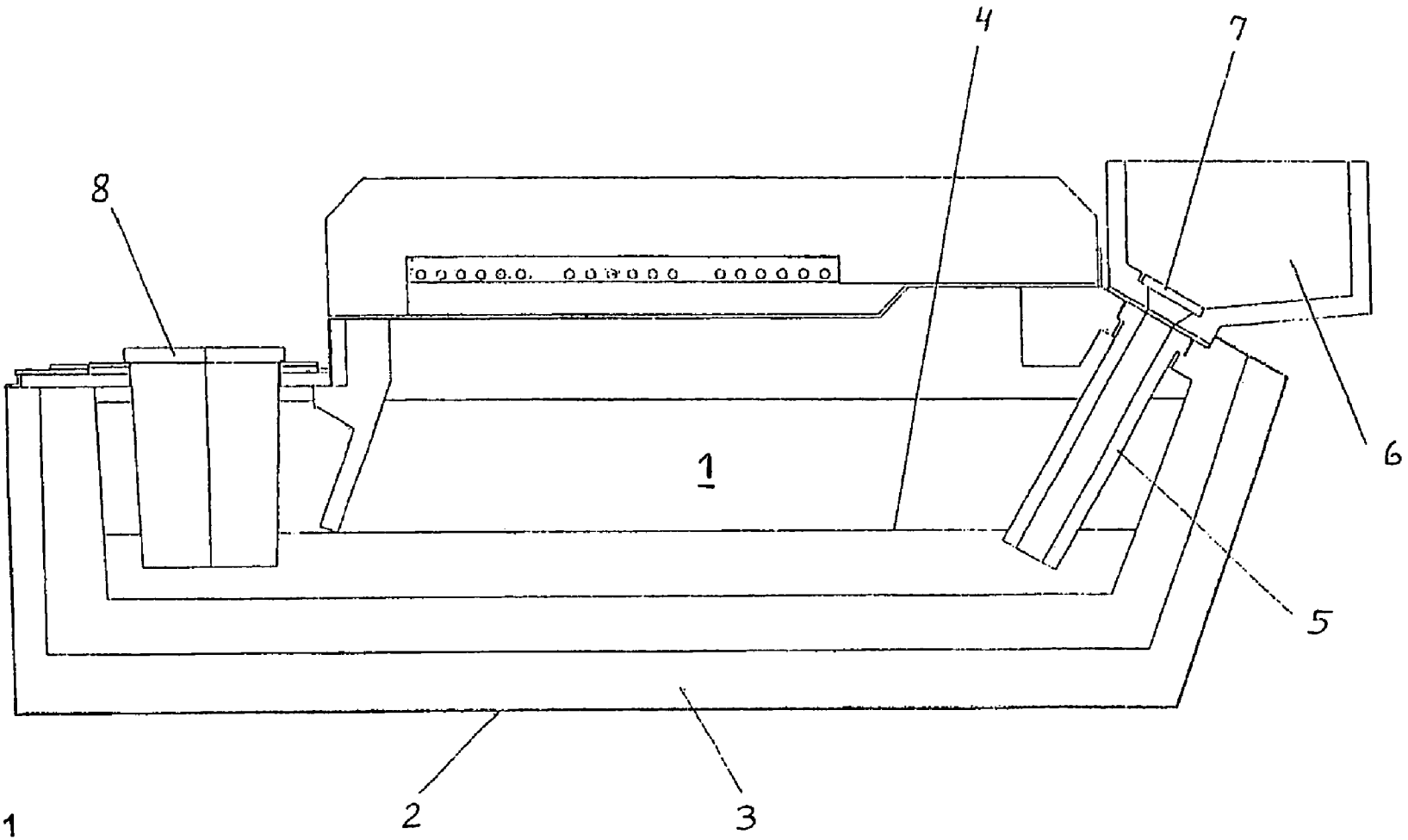
Figure 2:
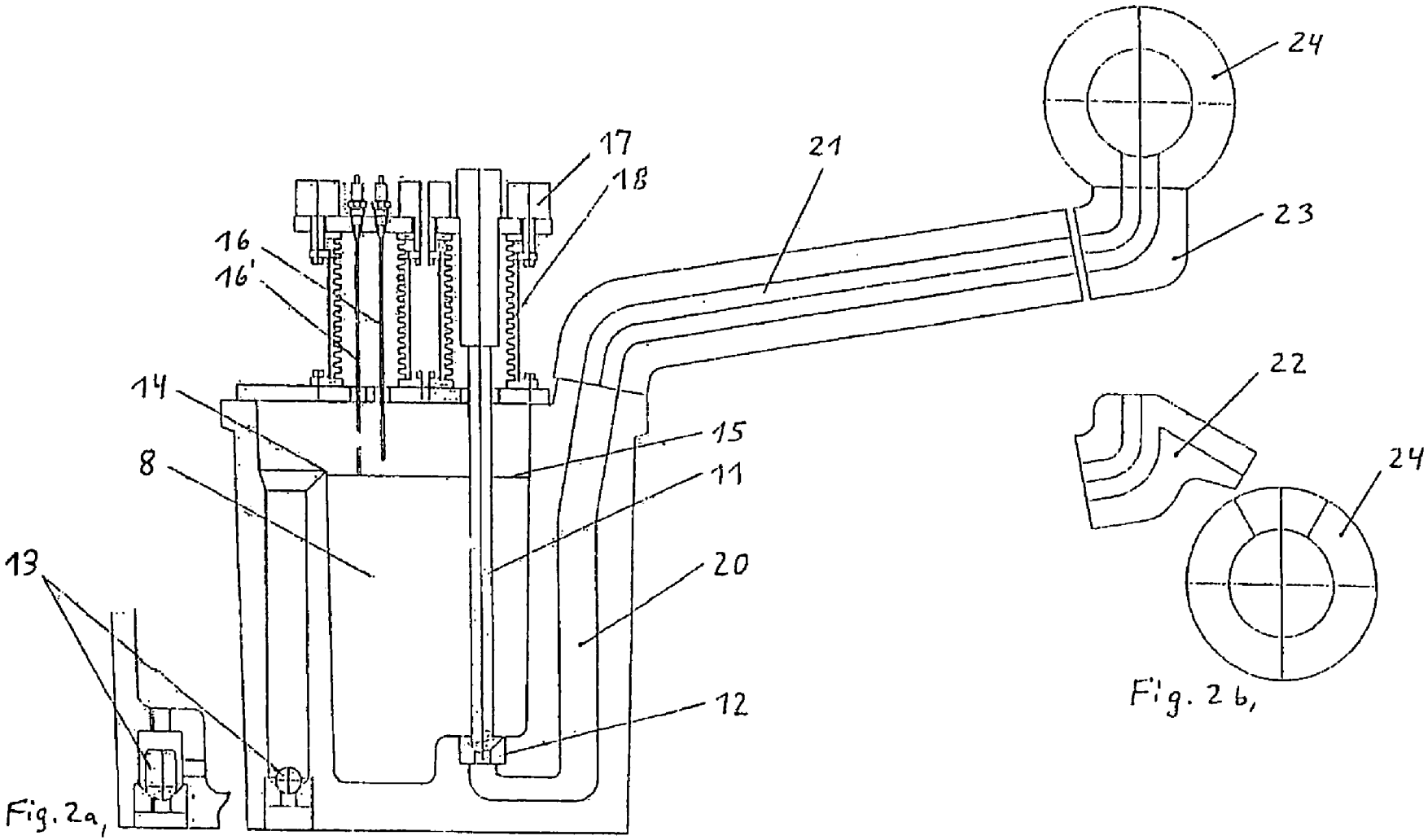
FIG. 2*a* metering device for a molten bath with detailed variants.
FIG. 2*b* a metering device for a molten bath with detailed variants.
Figure 3:
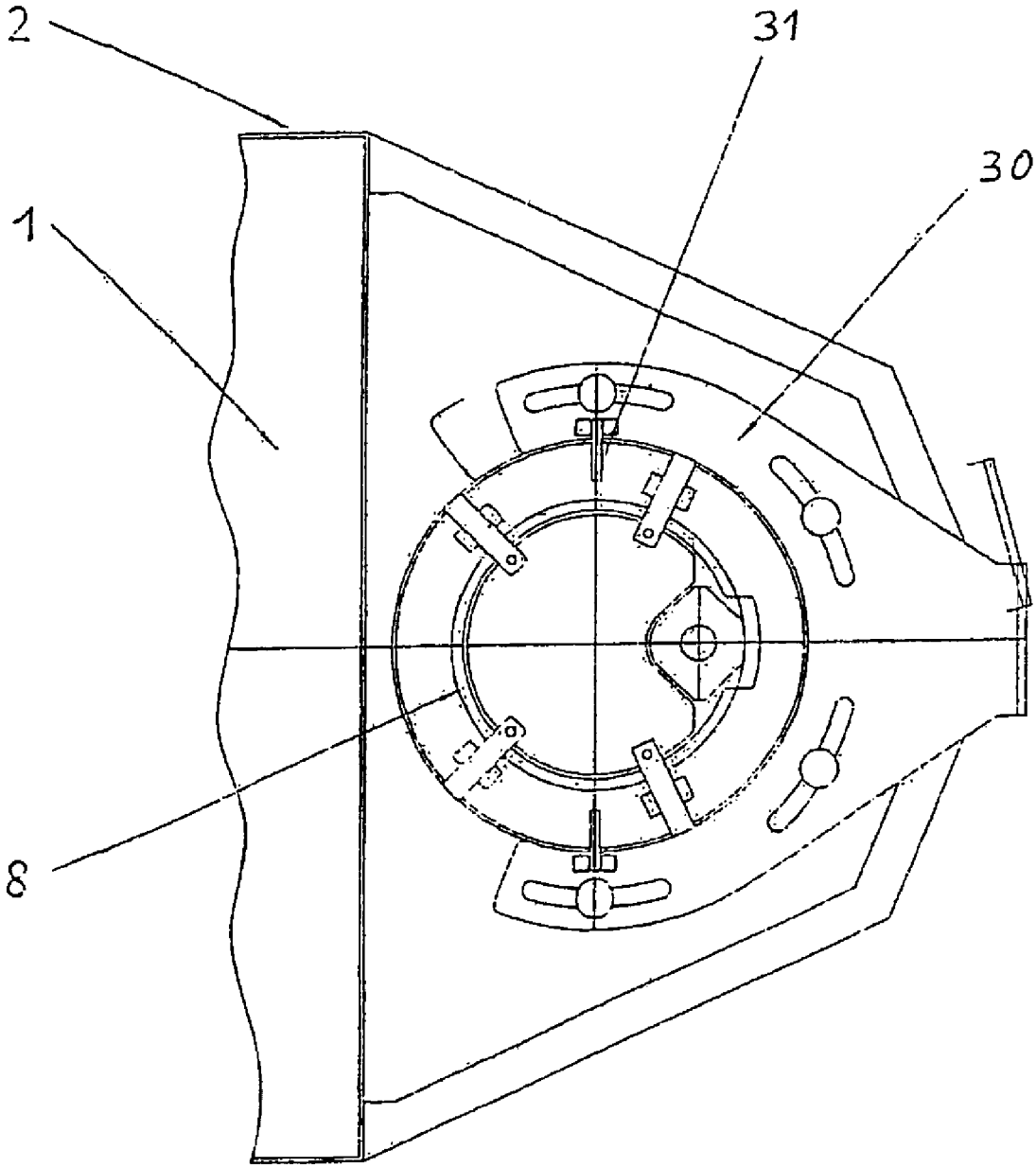
FIG. 3 a rotating and tilting device, top view.
Figure 4:
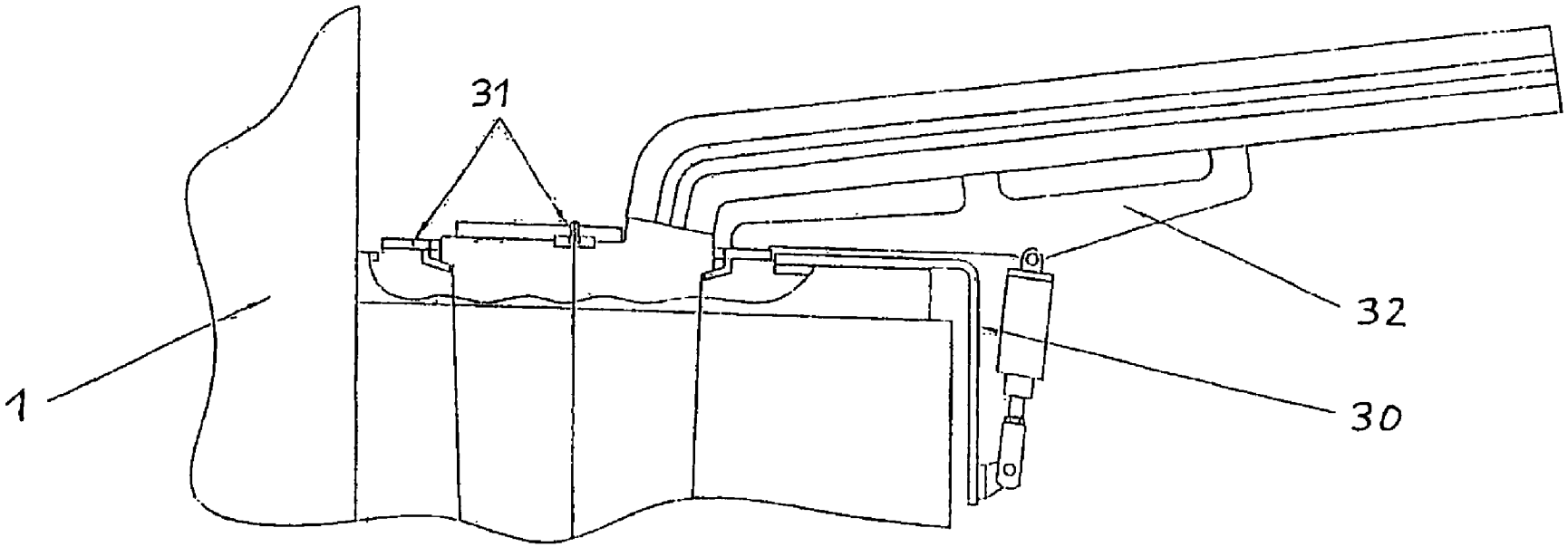
FIG. 4 a rotating and tilting device, side view.
Figure 5:
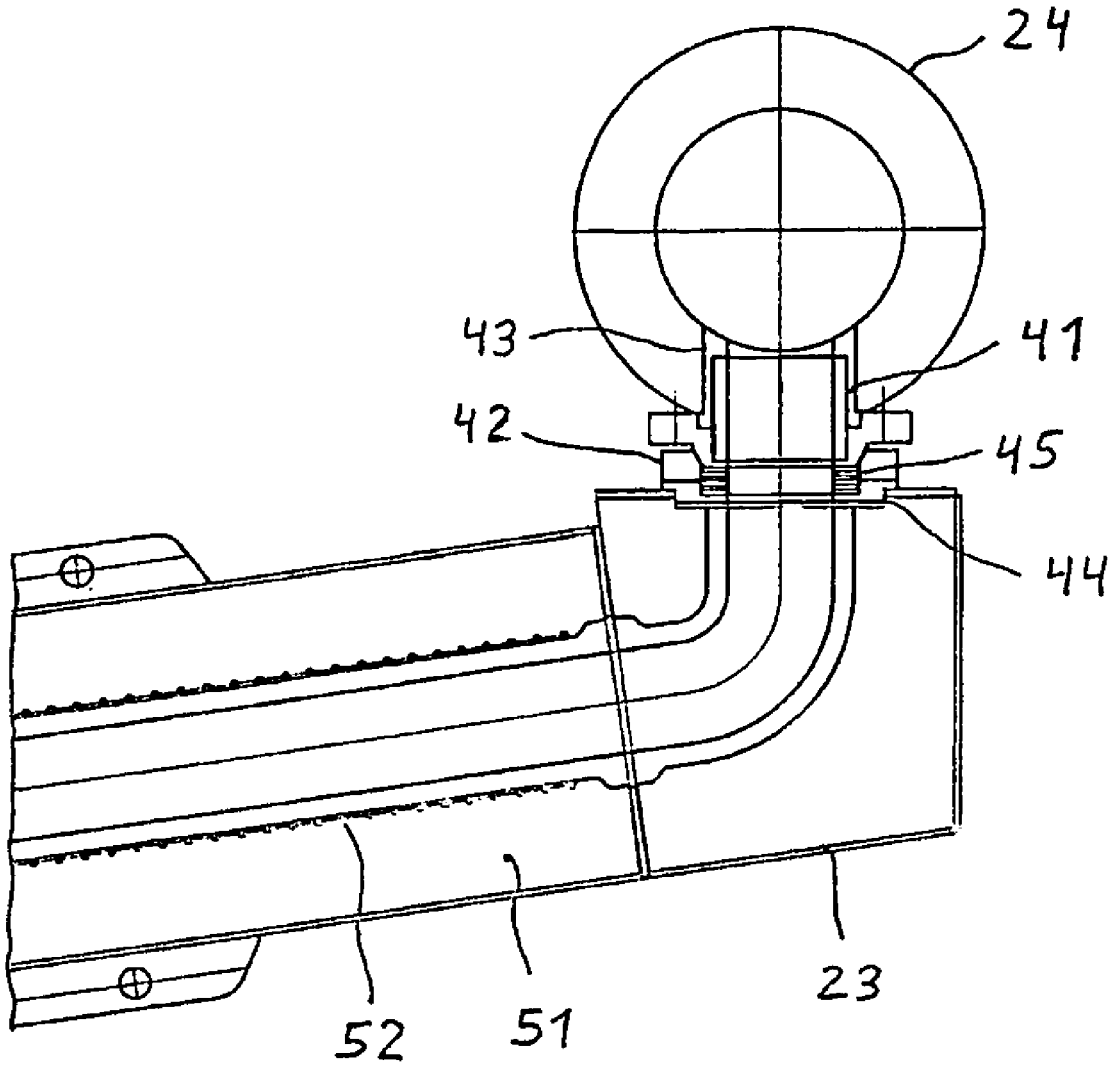
FIG. 5 a detailed view of the conveying tube.

A holding furnace 1, e.g., for molten aluminum, usually consists of a force absorbing steel bath 2 with a heatproof insulation 3. Heating takes place via cover, immersion or floor heaters (not explicitly shown) . The holding furnace 1 is filled up to a minimal fill level 4 with molten aluminum.

The molten bath is supplied via a tube 5, which tightly seals a fill hole of the steel bath 2, and whose lower end is always located under the fill level 4, thereby greatly reducing oxide formation and gas introduction while filling. A funnel 6 is placed on the tube 5, and the molten metal passes from the funnel 6 through a filter 7 and into the tube 5.

Situated in another opening of the steel bath 2 is a metering chamber 8, which incorporates a metering device for the quantity of molten bath to be metered per casting process. The metering device contains an outlet valve with a valve rod 11 and a valve seat 12. The valve seat 12 establishes the connection to a riser 20. The valve rod 11 is held at the upper end in a gastight and heat-resistant expansion bellows 18, and guided and driven with a pneumatic cylinder 17. An analogous gastight driving unit can be situated parallel to this valve driving unit for the active actuation of two scanning electrodes 16 and 16'. At the start of the metering sequence, a molten bath is pneumatically siphoned into the metering chamber 8 via a floor valve (passive inlet valve 13) and/or a spillway 14. This aspiration is abruptly ended once the scanning electrodes 16 and 16' have responded (melt surface 15).

The scanning electrodes 16 and 16' quickly return. As a result, they are not exposed as much to the molten bath, so that a disruptive thread formation can be largely prevented. The spillway 14 or an active or passive floor valve 13 prevent or limit the backflow of molten bath from the metering chamber 8 into the holding furnace 1. After the outlet valve 11, 12 has opened, molten bath can be pneumatically fed to the casting machine via the riser 20. Once the metering quantity is reached, the valve rod 11 closes the valve seat 12, thereby precisely terminating the metering process. Any backflow of molten bath from the riser 20 into the metering chamber 8 is reliably prevented.

The melt level (melt surface 15) can be kept at slightly overflowing levels, which can increase metering accuracy.

Electrodes 16, 16' must "hit" the pneumatic cylinder 17 during their return motion to loosen adhering metal.

The riser 20 can be connected with an outlet nozzle 22 via a conveying tube 21, or with the casting chamber 24 via a docking unit 23.

Only the method described causes the outlet valve and conveying tube 21 to be only minimally influenced by oxides/slag, ensuring a reliable melt transfer.

The docking unit 23 has an angle-independent and laterally moveable positioning aid in the form of a spherical cap 44. A ceramic bushing 41 is placed in the unheated area between the docking unit and outlet (opening 43) in the casting chamber 24 as insulation, enabling a precise metering from below by avoiding solidified areas. A sealing element 45 is incorporated into the docking unit 23 between the conveying tube 21 and spherical cap 44. This arrangement makes it possible to adjust the angles, and also to balance out an axial displacement of up to approx. ±2 mm. The opening 43 of the casting chamber 24 is designed as a replaceable bushing 42 (wearing bushing). It is made out of gray cast iron, making for a cost-effective replacement part with good melting resistance.

The conveying tube 21 is provided with a heater 52 and foamed insulation 51.

To ensure a tight transition to the holding furnace 1, a ceramic sealing ring 53 is arranged between the conveying tube 21 and holding furnace 1, and additionally enveloped by a steel ring 54, which ensures an uninterrupted dissipation of thermal energy at the transition. As a result, the exiting molten bath undergoes targeted solidification given a leak, ensuring a good service life of the connection, and simplifies handling.

The metering device including conveying tube 21 is rotatably and tiltably accommodated in the holding furnace 1 to ensure optimal adjustability of the melt transfer to the location and position of the casting chamber 24. The rotating and tilting device consists of a turning arm 30, in which a tilting ring 31 with built-in metering chamber 8 is used. The conveying tube support 32 is rigidly connected with this tilting ring 31. The forces acting on the conveying tube 21 are converted as quickly as possible into a movement of the rotating and tilting device, which reduces the load on the conveying tube 21, thereby increasing the service life.

The holding furnace 1 can be arranged on a hoisting device in the form of a scissor-type jack. Since the actuating cylinders for the scissor-type jack can be situated laterally outside on the steel bath 2, the minimal structural height of the scissor-type jack can kept low.

REFERENCE LIST

1 Holding furnace
2 Steel bath
3 Insulation
4 Fill level
5 Tube
6 Funnel
7 Filter
8 Metering chamber
11 Valve rod
12 Valve seat
13 Passive inlet valve
14 Spillway
15 Melt surface
16 Electrode
16' Electrode
17 Pneumatic cylinder
18 Expansion bellows
20 Riser
21 Conveying tube
22 Outlet nozzle
23 Docking unit
24 Casting chamber
30 Turning arm
31 Tilting ring
32 Conveying tube support
41 Ceramic bushing
42 Bushing
43 Opening
44 Spherical cap
45 Sealing element
51 Insulation
52 Heater

The invention claimed is:

1. A holding furnace for light molten baths, the holding furnace comprising:

a metering chamber;

a conveying tube;

a riser;

an application site;

a valve rod; and a sealable outlet opening, which empties into the riser, with which the molten bath is meterable to the application site, wherein the outlet opening is actively sealable with the valve rod, and wherein the metering chamber with the conveying tube is rotatably and tiltably mounted in the holding furnace.

2. The holding furnace according to claim 1, further comprising expansion bellows to drive the valve rod in a gastight and heat-resistant manner.

3. The holding furnace according to claim 1, further comprising scanning electrodes wherein the scanning electrodes are actively retractable while filling the metering chamber after a melt surface has been scanned.

4. The holding furnace according to claim 3, further comprising expansion bellows, wherein the expansion bellows are used to drive the return motion of the scanning electrodes in a gastight and heat-resistant manner.

5. The holding furnace according to claim 3, further comprising a spillway in the metering chamber, and scanning electrodes; wherein the melt surface can be scanned before a spillway is reached.

6. The holding furnace according to claim 1, further comprising an actively actuated inlet valve for introducing metal melt into the metering chamber.

7. The holding furnace according to claim 1, further comprising a concentric arrangement of a turning arm and a tilting ring, wherein the concentric arrangement achieves a maximum isolation of the metering chamber filled with molten bath.

8. The holding furnace according to claim 1, wherein the molten bath can be transferred from the metering chamber via the riser and into a casting groove, a tube system, a casting chamber or a casting mold by pressurization with an inert gas.

9. The holding furnace according to claim 1, wherein the conveying tube has a docking unit provided with a positioning aid.

10. The holding furnace according to claim 9, wherein the positioning aid comprises a spherical cap.

11. A holding furnace according to claim 9, wherein a melt transfer path after the docking unit is insulated by a ceramic bushing, which is inserted in a replaceable wearing bushing in a casting chamber.

12. The holding furnace according to claim 1, further comprising a passive inlet valve for introducing metal melt into the metering chamber.

* * * * *